United States Patent [19]

Haag et al.

[11] Patent Number: 4,858,971

[45] Date of Patent: Aug. 22, 1989

[54] ELECTRONIC VEHICLE DOOR LOCK/UNLATCH CONTROL

[75] Inventors: Ronald H. Haag, East Detroit; Mark Manuel, Warren; Lloyd W. Rogers, Utica, all of Mich.

[73] Assignee: General Motors Corporation, Detroit, Mich.

[21] Appl. No.: 164,903

[22] Filed: Mar. 7, 1988

[51] Int. Cl.[4] ..... E05C 9/00

[52] U.S. Cl. ..... 292/201; 292/46; 292/336.3

[58] Field of Search ..... 292/336.3, 201, 144, 292/292, DIG. 43, 46; 70/238, 264

[56] References Cited

U.S. PATENT DOCUMENTS 3,386,761 6/1968 Johnstone et al. ..... 292/201
4,364,249 12/1982 Kleefeldt ..... 292/201 X
4,624,491 11/1986 Vincent ..... 292/201
4,778,206 10/1988 Matsumoto et al. ..... 292/201

*Primary Examiner*—Richard E. Moore
*Attorney, Agent, or Firm*—Robert M. Sigler

[57] ABSTRACT

An electronic door lock/unlatch control in which the latching mechanisms latch mechanically upon door closing and include electric motor driven unlatching mechanisms but no mechanical locking apparatus. Locking is accomplished electronically for each door by a flip-flop which enables or disables a power MOSFET connected in series with the unlatch motor and unlatch switch for the door and an electric power source. The flip-flop for each door also controls lock status indicating lights. A rear door unlatch disable switch is included additionally in series with the rear door unlatch switch to allow operator disabling of the rear doors.

2 Claims, 2 Drawing Sheets

ELECTRONIC VEHICLE DOOR LOCK/UNLATCH CONTROL

BACKGROUND OF THE INVENTION

This invention is directed toward door locking and unlatching apparatus for a motor vehicle and particularly toward a new arrangement of powered door locking and unlatching apparatus.

Each door on a motor vehicle typically includes a latch and lock mechanism which automatically latches the door when the door is closed and includes inside and outside mechanical unlatching handles attached by mechanical links to the latch and lock mechanism for unlatching. The lock and latch mechanism further includes a locking mechanism which prevents unlatching and is operable by means of an additional mechanical link to a lock button or directly from the outside by a key. A power lock apparatus adds an electric motor for each door which is operable electrically in response to at least one switch and is linked mechanically to the lock mechanism through a lost motion link. The power locking feature is obtained by adding the necessary apparatus to the already existing traditional mechanical latch and lock mechanism and is not optimized for cost or operator convenience.

SUMMARY OF THE INVENTION

This invention is an electronic door lock/unlatch control for a motor vehicle based on a simplified mechanical apparatus and including electronic control of locking and unlatching. Vehicle front and rear doors each have a mechanical latch mechanism adapted to latch the door automatically upon door closure and a mechanical unlatch mechanism driven by an electric motor, when activated, to unlatch and partially open the door. The front door may be opened by completing a circuit from a vehicle electric power source through a front door unlatch switch and a first transistor in series with the motor, providing the first transistor, which has a control electrode controlled by a first bistable device, is enabled by a first state of the bistable device. If the transistor is disabled by the second state of the bistable device, the door does not open and is effectively locked. A similar arrangement exists for the rear door with a rear unlatch switch and a second transistor controlled by a second bistable device.

Front lock and unlock switches are effective to put both bistable devices in their second and first states, respectively, to control locking and unlocking of both doors. Rear lock and unlock switches are effective to control only the second bistable device and therefore the locking and unlocking of the rear door only. A rear unlatch disable switch is further provided in series with the second transistor, rear door unlatch switch and the electric motor of the rear unlatch mechanism to selectively prevent unlatching of the rear door when the rear unlatch switch is activated.

Lock and unlock indicating lights are provided for each of the front and rear doors; and an indicating light drive circuit for each indicating light is responsive to an enabling input and the output of the bistable device controlling enablement of the unlatching mechanism of the associated door to indicate the lock/unlock status thereof. A timing circuit is effective to supply the enabling signal to the indicating light drive circuits while provided with an activating voltage input and for a predetermined time after removal of the activating voltage input. A door jamb switch is connected to the electric power source and activated while the front door is open to provide the activating voltage to the timing circuit; and circuit means is connected to the electric power source through the ignition switch to further provide the activating voltage to the timing circuit, whereby the lock/unlock status of the locks is displayed while the ignition switch is closed, while the front door is open and for at least the predetermined time thereafter. Further details and advantages of the invention will be apparent from the accompanying drawings and following description of a preferred embodiment.

DESCRIPTION OF THE PREFERRED EMBODIMENT

Figure 1:
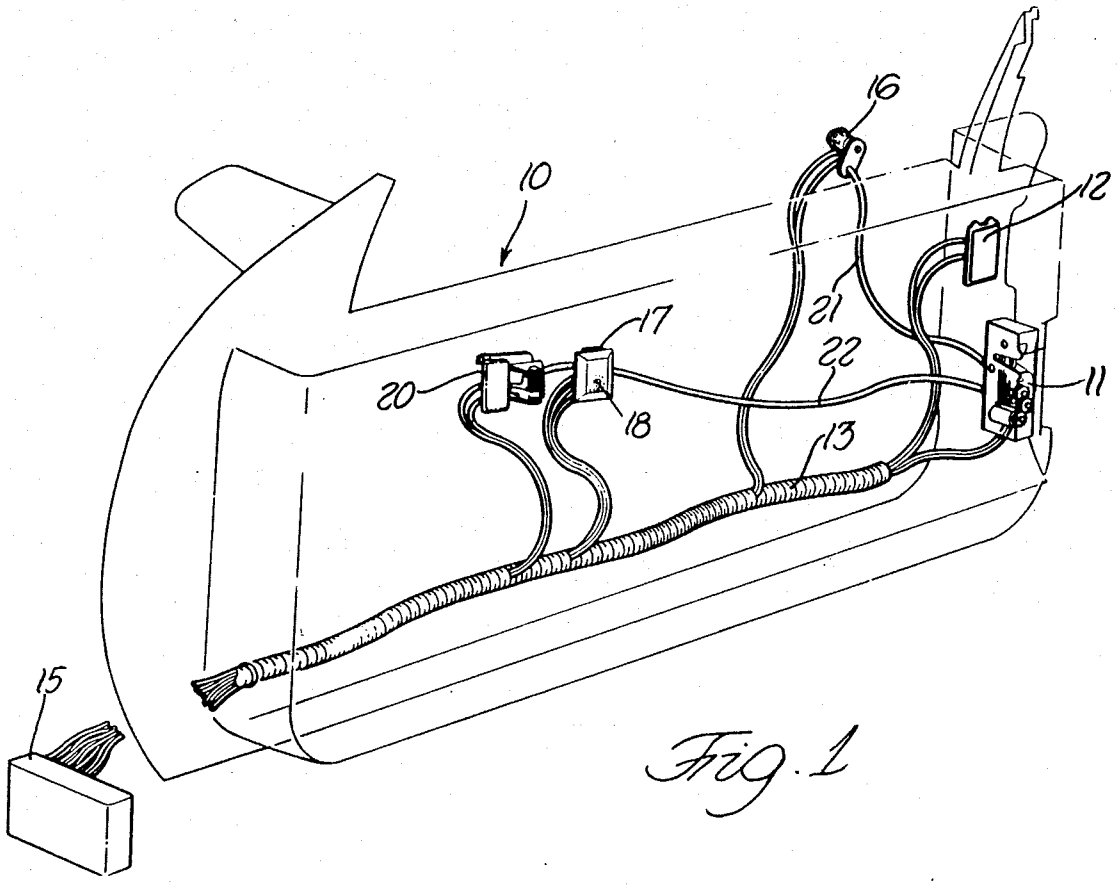
FIG. 1 is a drawing of one door of a vehicle equipped with the invention showing the mechanical arrangement of certain parts of the invention.

Referring to FIG. 1, a front door 10 of a motor vehicle includes a latch assembly 11 including a latch mechanism of any type which cooperates with a stationary member on the door frame to automatically latch the door when the door closes. Latch assembly 10 further includes an electric motor driven unlatch mechanism effective, when the electric motor is energized, to unlatch the door, whereupon the door opens slightly to prevent relatching. Such assemblies are known in the prior art for use in vehicle trunk latches with power unlatch apparatus. It is not necessary, however, for latch assembly 10 to include any extra mechanical locking members, since locking and unlocking will be accomplished electronically by preventing or enabling energization of the electric motor unlatch mechanism.

An exterior door release 12 comprises an electric switch which may be mounted on the rear surface of a partial cover over an alcove in the vehicle body for actuation by the fingers of an operator's hand inserted in the alcove. Exterior door release 12 is connected through a wiring harness 13 to an electronic control module 15 which is also connected through the harness to the electric motor of latch assembly 10. Activation of exterior door release 12 will cause unlatching of the door in a manner to be described. An exterior electronic lock/unlock module 16 includes exterior lock and unlock switches which may be key activated. The switches will be described in more detail in connection with FIG. 2; however, they are connected through wiring harness 13 to electronic control module 15 to provide for locking and unlocking front door 10. Similarly, an interior electronic lock/unlock module 17 includes lock and unlock switches to provide a similar capability from the inside of the vehicle, although these would not be key operated. A door lock indicator light 18 is provided on lock/unlock module 17 or in some other convenient place to indicate the lock/unlock status of the door. An interior door release 20 comprises an electric switch activatable from within the vehicle to unlatch and open the door. It may be mechanically similar to the exterior door release 12.

The apparatus described above is duplicated for each door on the vehicle, except that there is only one electronic control module 15. The number of switches is optional: for example, it may be desired to have no exterior lock/unlock module 16 on the rear doors. In addition, although not shown in FIG. 1, there is at least one rear unlatch disable switch within reach of the vehicle driver and also connected to the electronic control module 15. The purpose and function of this switch will be described in more detail, along with the others, with reference to the circuit of FIG. 2.

Although the apparatus described to this point would be sufficient for an operational system, the preferred embodiment also provides optional mechanical release apparatus in case the electronics becomes inoperable. Exterior electronic lock/unlock module 16 and interior electronic lock/unlock module 20 both further comprise manual latch releases connected to latch assembly 11 by actuating cables 21 and 22, respectively. Activation of either manual release pulls the respective actuating cable to actuate the release mechanism in latch assembly 11 as would be done by the driving motor and thereby unlatch the door, whereupon the door springs open slightly to prevent relatching just as if it had been unlatched by the driving motor. The manual releases would not have to be combined with the electronic lock/unlock modules; but it is convenient to do so, especially for the exterior release which is preferably key operated.

Figure 2:
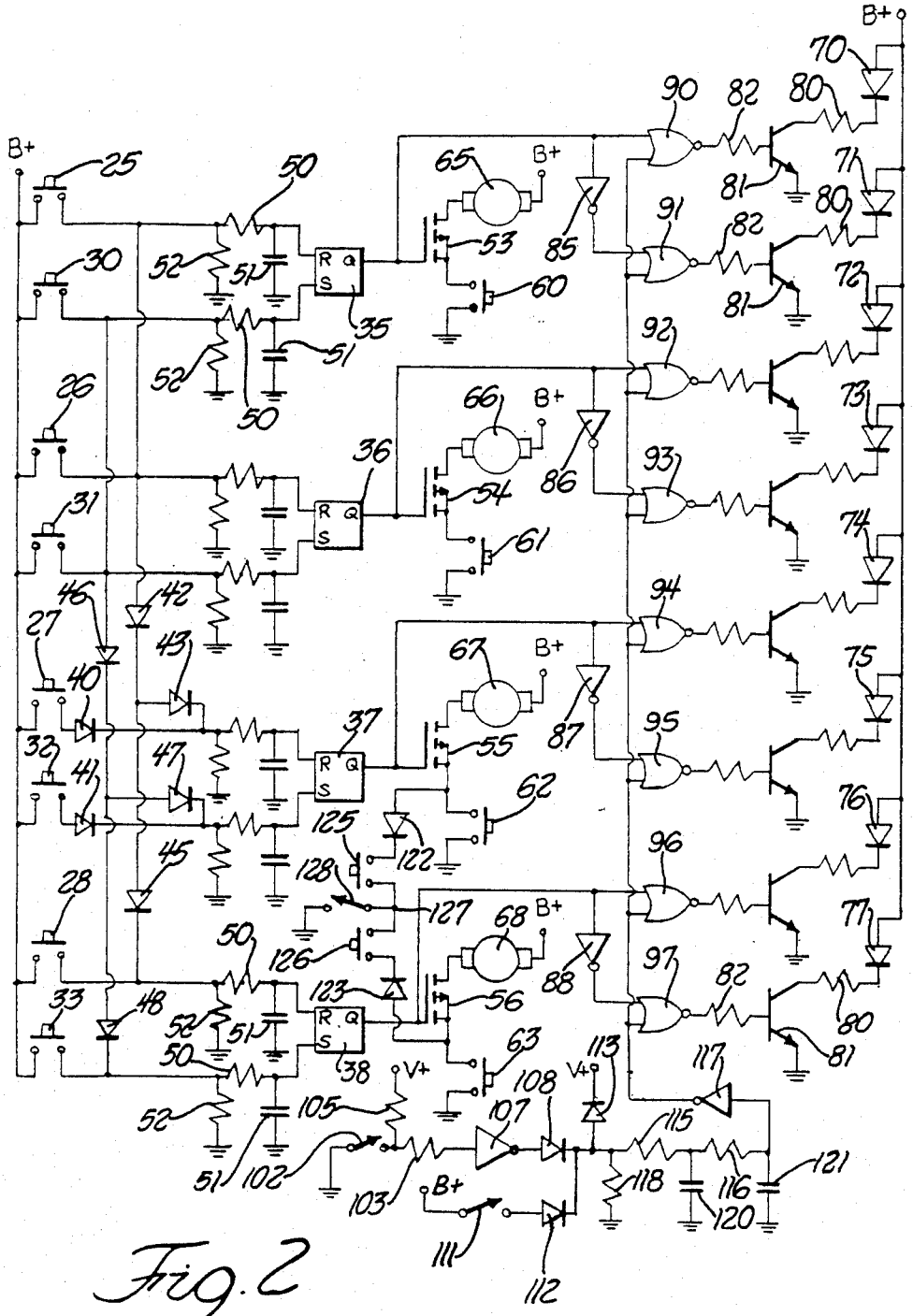
FIG. 2 is an electrical circuit diagram of the apparatus of the invention.

A circuit diagram of a preferred embodiment of an entire vehicle system is shown in FIG. 2. Switches 25–28 represent the lock switches for the left front, right front, left rear and right rear doors respectively. Each such switch could be the lock switch in either exterior lock/unlock module 16 or interior lock/unlock module 17. If both switches are included, they are connected in parallel; however, only one is shown to simplify the drawing. Similarly, switches 30–33 represent the unlock switches for the same doors. Switches 25–28 and 30–33 are all of the normally open, momentary contact type which are closed only as long as they are activated by the operator. As will be seen when more of the circuit is described, activation of any of the lock switches 25–28 causes locking of the latch assembly 11 for the associated door; and activation of any of the unlock switches 30–33 causes unlocking of the latch assembly for the associated door.

Switches 25–28 are connected between the positive terminal B+ of an electric power source, which is preferably the normal vehicle battery and alternator system, and the reset inputs of R/S flip-flops 35–38, respectively. Similarly, switches 30–33 are connected between power supply terminal B+ and the set inputs of flip-flops 35–38 respectively. As will be seen, flip-flops 35–38 control the lock/unlock status of the doors; and each door is thus provided with the required lock and unlock switch capable of locking and unlocking that door.

However, the front left and right door lock and unlock switches are further connected to activate the locking and unlocking of all other doors. The connections described above for switches 27 and 32 to the reset and set inputs of flip-flop 37 are through diodes 40 and 41, respectively. Furthermore, switch 25 connects power supply terminal B+ to the reset input of flip-flop 36, through diodes 42 and 43 in series to the reset input of flip-flop 37; and through diodes 42 and 45 in series to the reset input of flip-flop 38. Similarly, switch 30 further connects power supply terminal B+ to the set input of flip-flop 35, through diodes 46 and 47 in series to the set input of flip-flop 37, and through diodes 46 and 48 in series to the set input of flip-flop 38. It will be seen that, as a result of the connections described, both switches 25 and 26 are effective to reset all flip-flops 35–38 and both switches 30 and 31 are effective to set all flip-flops 25–38. However, the diodes prevent switches 27, 28, 32 and 33 from affecting any more than one of flip-flops 37 and 38.

Each of the set and reset inputs of flip-flops 35–38 is provided with a resistor 50 in series to the switch (25–28, 30–33) and a capacitor 51 to ground with a resistor 52 to ground from the other end of resistor 50. These elements provide debouncing for the flip-flops. The reference numerals are shown only on those associated with flip-flop 35, but the others are similar. In addition, flip-flops 35–38 obtain their own operating electrical voltage from a standard regulated voltage supply, not shown, of an appropriate voltage which, in turn, is supplied by the vehicle electric power source.

The Q outputs of flip-flops 35–38 are connected to the gates or control electrodes of power MOSFETs 53–56, respectively. MOSFETs 53–56 have sources connected through unlatch switches 60–63, respectively, to ground and drains connected through motors 65–68, respectively, to electric power source terminal B+. The motors 65–68 are the activating or drive motors for the latch assemblies of the left front, right front, left rear and right rear doors, respectively; and the switches 60–63 are the unlatch switches for the same doors. Switches 60 and 61 may represent the switches in either interior door release 20 or exterior door release 12; however, switches 62 and 63 represent the switches in only exterior door release 12. The switches for interior door release 20 on the left and right rear doors will be described at a later point in this description.

When one of flip-flops 35–38 is reset, its Q output is a low voltage which, applied to a controlled MOSFET gate, prevents the controlled MOSFET from conducting. This prevents the motor from being energized when the unlatch switch is closed and effectively locks the door. If the flip-flop is set, however, its Q output is high to enable the controlled MOSFET; and closure of the unlatch switch in series with the MOSFET will complete a circuit therethrough to energize the associated motor. Thus, the door is effectively unlocked.

Apparatus is further provided for indicating the lock/unlock status of each door. Indicating lights may take the form of light emitting diodes (LEDs) 70–77 which indicate, when lit, left front door locked, left front door unlocked, right front door locked, right front door unlocked, left rear door locked, left rear door unlocked, right rear door locked and right rear door unlocked, respectively. Each of LEDs 70–77 is connected from the electric power source terminal B+ through a resistor 80 to the collector of an NPN bipolar transistor 81 having a grounded emitter and a base with a base resistor 82 connected thereto. These reference numerals are shown only for the upper two LEDs 70 and 71, but the others are similar. The transistors 81 switch current through the associated LEDs 70–77 and thus control their illumination. Each of LEDs 70–77 is controlled by a NOR gate 90–97 having an output connected through the associated base resistor 82 to the controlling transistor 81. Each of NOR gates 82 has two inputs, one of which is connected in a manner to be described below to receive an LED enabling signal and the other of which is connected to receive a control signal for the individual door. This control signal is received, for NOR gates 90, 92, 94 and 96, from the Q output of flip-flops 35–38, respectively. Thus, each of LEDs 70, 72, 74 and 76 is lit only when the Q output of flip-flop 35–38, respectively, is high. The control signals for NOR gates 91, 93, 95 and 97 are obtained from the Q outputs of flip-flops 35–38 inverted by inverters 85–88, respectively or, alternatively, may be obtained from the NOTQ outputs of flip-flops 35–38. Thus, each of LEDs 71, 73, 75 and 77 may be lit only when its associated door is unlocked.

The LED enabling signal is generated in either of three ways: (1) when at least the left front or driver's door is open, (2) when the vehicle ignition switch is closed, and (3) for a predetermined time after either (1) or (2). A door jamb switch 102 opens and closes with the left front door. The switch may be the standard door jamb switch used for many years to activate interior vehicle lights when the door is open. It is connected to ground from a junction 103 of a resistor 105 connected to electric power source terminal B+ and a resistor 106 connected through an inverter 107 and diode 108 in series to a junction 110. Resistor 105 is connected in parallel with the aforementioned interior vehicle lights. The vehicle ignition switch 111 is connected from electric power source terminal B+ through a diode 112 to junction 110. A diode 113 is connected from junction 110 to electric power source terminal B+ to limit the voltage thereon. Thus, battery voltage will appear on junction 110 when the left front door is open or the vehicle ignition switch 102 is closed, with diodes 108 and 112 providing isolation between the input circuits. Ground voltage will appear on junction 110 when the left front door is closed and ignition switch 102 is open.

Junction 110 is connected through a resistor 115, a resistor 116 and an inverter 117 in series to the other inputs of NOR gates 90–97, with the output of the inverter 117 providing the LED enabling signal. A resistor 118 is connected from junction 110 to ground; a capacitor 120 is connected from the junction of resistors 115 and 116 to ground; and a capacitor 121 is connected from the junction of resistor 116 and inverter 117 to ground. Elements 115, 118 and 120 comprise a timer, with capacitor 120 charging within a few milliseconds through either of diodes 108 and 112 and resistor 115, which has a very low resistance, when either of the diodes becomes forward biased. However, when diodes 108 and 112 become reverse biased, capacitor 120 discharges at a much slower rate through resistors 115 and a much larger resistance in resistor 118. The values are adjusted so that, once capacitor 120 is charged, the LED enabling signal is continued for about 30 seconds after diodes 108 and 112 become reverse biased. This will generally provide continuous lock indication from the time the vehicle operator first opens the left front door until 30 seconds after the operator exits the vehicle and closes the door.

The sources of MOSFETs 55 and 56 are further connected through diodes 122 and 123, respectively, in series with left and right interior rear unlatch switches 125 and 126, respectively, to a junction 127, which is connected through a rear unlatch disable switch 128 to ground. Switch 128 is located within reach of a vehicle operator but out of reach of a passenger using the rear door and must be closed to enable the rear interior unlatch disable switches 125 and 126. This provides the opportunity for the vehicle operator to prevent interior rear door opening, a feature which might appeal to parents with small children.

The embodiments of the invention in which an exclusive property or privilege is claimed are defined as follows:

1. An electronic door lock/unlatch control for a motor vehicle having an electric power source, an ignition switch connected to the electric power source and at least one front door and one rear door, each of the front and rear doors having a mechanical latch mechanism adapted to latch the door automatically upon door closure and having a mechanical unlatch mechanism driven by an electric motor, when activated, to unlatch and partially open the door, the control comprising, in combination:

a front door unlatch switch;

a first transistor connected in series with the front door unlatch switch and electric motor of the front unlatch mechanism across the electric power source, the first transistor having a control electrode;

a first bistable device having an output connected to the control electrode of the first transistor and being characterised by a first state effective to enable conduction of the first transistor upon closure of the front door unlatch switch and a second state in which conduction of the first transistor is prevented;

a front door unlatch switch;

a rear door unlatch switch;

a second transistor connected in series with the rear door unlatch switch and the electric motor of the rear unlatch mechanism across the electric power source, the second transistor having a control electrode;

a second bistable device having an output connected to the control electrode of the second transistor and being characterised by a first state effective to enable conduction of the second transistor upon closure of the rear door unlatch switch and a second state in which conduction of the second transistor is prevented;

a front lock switch connected to the electric power source and the first and second bistable devices and effective, when closed, to put the first and second bistable devices in their second states to disable unlatching of the front and rear doors;

a front unlock switch connected to the electric power source and the first and second bistable devices and effective, when closed, to put the first and second bistable devices in their first states to enable unlatching of the front and rear doors;

a rear lock switch connected to the electric power source and the second bistable device and effective, when closed, to put the second bistable device in its second state to disable unlatching of the rear door;

a rear unlock switch connected to the electric power source and the second bistable device and effective, when closed, to put the second bistable device in its first state to enable unlatching of the rear door;

a rear unlatch disable switch connected in series with the second transistor, rear door unlatch switch and the electric motor of the rear unlatch mechanism across the electric power source, the rear unlatch disable switch being located within reach of a vehicle operator but out of reach of a passenger using the rear door and effective, when open, to prevent unlatching of the rear door;

front lock and unlock indicating lights associated with the front door;

rear lock and unlock indicating lights associated with the rear door;

an indicating light drive circuit for each of the front lock, front unlock, rear lock and rear unlock indicating lights responsive to an enabling input and the output of the bistable device controlling enablement of the unlatching mechanism of the associated door to indicate the lock/unlock status thereof;

a timing circuit effective to supply the enabling signal to the indicating light drive circuits while provided with an activating voltage input and for a predetermined time after removal of the activating voltage input;

a door jamb switch connected to the electric power source and activated while the front door is open to provide the activating voltage to the timing circuit; and circuit means connected to the electric power source through the ignition switch to provide the activating voltage to the timing circuit, whereby the lock/unlock status of the locks is displayed while the ignition switch is closed, while the front door is open and for at least the predetermined time thereafter.

2. An electronic door lock/unlatch control for a motor vehicle having an electric power source, an ignition switch connected to the electric power source and at least one front door and one rear door, each of the front and rear doors having a mechanical latch mechanism adapted to latch the door automatically upon door closure and having a mechanical unlatch mechanism driven by an electric motor, when activated, to unlatch and partially open the door, the control comprising, in combination:

a front door unlatch switch;

a first FET having a source and drain connected in series with the front door unlatch switch and electric motor of the front unlatch mechanism across the electric power source, the first FET further having a gate;

a first flip-flop having a Q output connected to the gate of the first FET and set and reset inputs, whereby the first flip-flop may be set to enable conduction of the first FET upon closure of the front door unlatch switch and reset to prevent such conduction;

a front door unlatch switch;

a rear door unlatch switch;

a second FET having a source and drain connected in series with the rear door unlatch switch and the electric motor of the rear unlatch mechanism across the electric power source, the second FET further having a gate;

a second flip-flop having a Q output connected to the gate of the second FET and set and reset inputs, whereby the second flip-flop may be set to enable conduction of the second FET upon closure of the rear door unlatch switch and reset to prevent such conduction;

a front lock switch connected between the electric power source and the reset inputs of the first and second flip-flops so as to reset the first and second flip-flops when closed and thereby disable unlatching of the front and rear doors;

a front unlock switch connected between the electric power source and the set inputs of the first and second flip-flops so as to set the first and second flip-flops when closed and thereby enable unlatching of the front and rear doors;

a rear lock switch connected between the electric power source and the reset input of the second flip-flop so as to reset the second flip-flop when closed and thereby disable unlatching of the rear door;

a rear unlock switch connected between the electric power source and the second flip-flop so as to set the second flip-flop when closed and thereby enable unlatching of the rear door;

a rear unlatch disable switch connected in series with the second FET, rear door unlatch switch and the electric motor of the rear unlatch mechanism across the electric power source, the rear unlatch disable switch being located within reach of a vehicle operator but out of reach of a passenger using the rear door and effective, when open, to prevent unlatching of the rear door;

front lock and unlock indicating LEDs associated with the front door;

rear lock and unlock indicating LEDs associated with the rear door;

an indicating LED drive circuit for each of the front lock, front unlock, rear lock and rear unlock indicating LEDs, each said indicating LED drive circuit comprising a transistor switch in series with the respective LED and electric power source and having a control electrode connected to a logic gate effective to activate the transistor switch to drive the respective LED in response to the simultaneous presence of an enabling input voltage and the Q output of the flip-flop controlling enablement of the unlatching mechanism of the associated door to indicate the lock/unlock status thereof;

an RC timing circuit comprising a capacitor quickly chargeable through a small resistance to a first predetermined voltage and effective, when not being charged, to slowly discharge through a larger resistance, the RC timing circuit providing the enabling input voltage when the capacitor is charged above a second predetermined voltage lower than the first predetermined voltage;

first circuit means including a door jamb switch responsive to the front door and connected to the electric power source, the first circuit means being effective to charge the capacitor of the RC timing circuit through an isolating diode only when front door, as indicated by the door jamb switch, is open; and second circuit means connecting the electric power source through the ignition switch and a second isolating diode to the capacitor of the RC timing circuit to charge the capacitor through the ignition switch when the ignition switch is closed, the RC timing circuit being effective to provide the enabling input voltage for a predetermined time after the latter of the closure of the front door and opening of the ignition switch as the capacitor discharges from the first predetermined voltage to the second predetermined voltage, whereby the lock/unlock status of the locks is displayed while the ignition switch is closed, while the front door is open and for at least the predetermined time thereafter.

* * * * *